US010695254B2

(12) United States Patent
Leier et al.

(10) Patent No.: US 10,695,254 B2
(45) Date of Patent: Jun. 30, 2020

(54) INVERSION APPARATUS

(71) Applicant: EXPECTATIONS, LLC, Puyallup, WA (US)

(72) Inventors: Christopher Henry Leier, Puyallup, WA (US); Lopin Wang, Taichung (TW)

(73) Assignee: Expectations, LLC, Bonney Lake, WA (US)

( * ) Notice: Subject to any disclaimer, the term of this patent is extended or adjusted under 35 U.S.C. 154(b) by 91 days.

(21) Appl. No.: 15/800,354

(22) Filed: Nov. 1, 2017

(65) Prior Publication Data

US 2018/0147107 A1 May 31, 2018

Related U.S. Application Data

(60) Provisional application No. 62/475,410, filed on Mar. 23, 2017, provisional application No. 62/427,843, filed on Nov. 30, 2016.

(51) Int. Cl.
*A61H 1/02* (2006.01)

(52) U.S. Cl.
CPC ... *A61H 1/0222* (2013.01); *A61H 2201/0192* (2013.01); *A61H 2201/1253* (2013.01); *A61H 2201/1619* (2013.01); *A61H 2201/1676* (2013.01); *A61H 2203/0493* (2013.01)

(58) Field of Classification Search
CPC ..... A63B 21/00047; A63B 21/005; A63B 21/0054; A63B 21/00185; A63B 2023/006; A63B 23/0205; A63B 23/0222; A63B 23/0211; A63B 23/0233; A63B 2210/00; A63B 2210/02; A63B 2210/50; A63B 17/00; A63B 17/02; A63B 17/04; A61H 2203/0493; A61H 1/0222; A61H 2201/0192; A61H 2201/1253; A61H 2201/1619; A61H 2201/1676
USPC ..... 482/144, 145, 148
See application file for complete search history.

(56) References Cited

U.S. PATENT DOCUMENTS

| | | | | |
|---|---|---|---|---|
| 3,081,085 | A * | 3/1963 | De Girolamo | A61H 1/0218 108/4 |
| 5,967,956 | A * | 10/1999 | Teeter | A61H 1/003 482/144 |
| 7,052,448 | B2 | 5/2006 | Teeter | |
| 7,118,518 | B1 | 10/2006 | Teeter | |
| 7,125,372 | B1 | 10/2006 | Teeter et al. | |

(Continued)

FOREIGN PATENT DOCUMENTS

| | | |
|---|---|---|
| CN | 2772485 | 4/2006 |
| CN | 102949814 A | 3/2013 |

(Continued)

*Primary Examiner* — Loan B Jimenez
*Assistant Examiner* — Zachary T Moore
(74) *Attorney, Agent, or Firm* — Dicke, Billig & Czaja, PLLC

(57) ABSTRACT

An inversion apparatus includes a support frame configured to movably support an inversion table. The support frame includes a forwardly extending foot platform that helps a user mount the apparatus when the apparatus is in an operative configuration, and that facilitates upright storage of the apparatus when the apparatus is in a compact configuration. The support frame also includes front and rear legs that pivot relative to one another to transform the apparatus between configurations.

17 Claims, 13 Drawing Sheets

(56) References Cited

U.S. PATENT DOCUMENTS

| | | | | |
|---|---|---|---|---|
| D551,725 | S | 9/2007 | Teeter | |
| D581,996 | S | 12/2008 | Teeter et al. | |
| 7,507,192 | B2 | 3/2009 | Teeter et al. | |
| 7,544,157 | B2 | 6/2009 | Teeter et al. | |
| 7,585,264 | B1 | 9/2009 | Wang et al. | |
| 7,625,326 | B2 | 12/2009 | Teeter et al. | |
| 7,625,327 | B1 | 12/2009 | Teeter et al. | |
| 7,663,653 | B2 | 2/2010 | Tsujino et al. | |
| D617,855 | S | 6/2010 | Leier | |
| 7,867,154 | B2 | 1/2011 | Teeter et al. | |
| 8,051,512 | B2 | 11/2011 | Teeter | |
| D650,025 | S | 12/2011 | Leier et al. | |
| D650,026 | S | 12/2011 | Leier et al. | |
| D664,220 | S | 7/2012 | Leier et al. | |
| 8,291,533 | B2 | 10/2012 | Teeter | |
| 8,480,543 | B1 | 7/2013 | Leier et al. | |
| 8,556,787 | B2 | 10/2013 | Leier et al. | |
| D806,810 | S | 1/2018 | Chen | |
| 2006/0234845 | A1 | 10/2006 | Teeter et al. | |
| 2007/0161477 | A1 | 7/2007 | Wang | |
| 2009/0054217 | A1 | 2/2009 | Teeter | |
| 2009/0124473 | A1 | 5/2009 | Teeter et al. | |
| 2009/0197746 | A1* | 8/2009 | Splane, Jr. | A63B 21/02 482/121 |
| 2010/0072790 | A1* | 3/2010 | Pleiman | A47D 1/0085 297/45 |
| 2010/0279838 | A1 | 11/2010 | Teeter et al. | |
| 2011/0218086 | A1 | 9/2011 | Boren | |
| 2013/0059705 | A1 | 3/2013 | Leier et al. | |
| 2013/0059706 | A1 | 3/2013 | Leier et al. | |
| 2014/0066276 | A1* | 3/2014 | Hornback | A63B 21/068 482/145 |
| 2015/0202110 | A1* | 7/2015 | Leier | A63B 21/00054 601/84 |
| 2016/0346158 | A1 | 12/2016 | Leier et al. | |
| 2018/0147107 | A1 | 5/2018 | Leier | |
| 2018/0250186 | A1 | 9/2018 | Leier | |
| 2018/0271737 | A1 | 9/2018 | Leier et al. | |

FOREIGN PATENT DOCUMENTS

| | | | | |
|---|---|---|---|---|
| CN | 208611703 | U | 3/2019 | |
| EP | 0097263 | A1 * | 1/1984 | A61H 1/0229 |
| TW | M424968 | U1 | 3/2012 | |

* cited by examiner

INVERSION APPARATUS

CROSS-REFERENCE TO RELATED APPLICATIONS

Disclosed herein is subject matter entitled to the earlier filing date of U.S. Provisional Application No. 62/427,843, filed Nov. 30, 2016; and U.S. Provisional Application No. 62/475,410, filed Mar. 23, 2017.

FIELD OF THE INVENTION

The present invention relates to exercise equipment, and more specifically, to methods and apparatus associated with inverting a person relative to an underlying floor surface.

BACKGROUND OF THE INVENTION

Along with cardio exercise and strength exercise, stretching and/or body manipulation may be considered another fundamental form of exercise or physical fitness that is important for overall health and well being. One specific form of beneficial stretching and/or body manipulation may be accomplished by inverting one's body relative to an underlying floor surface. Some examples of known inversion apparatus are disclosed in U.S. Pat. Nos. 5,967,951, 7,052,448, 7,663,653, 7,118,518, 7,125,372, 7,507,192, 7,544,157, 7,585,264, 7,625,326, 7,625,327, 7,867,154, 8,051,512, 8,291,533, 8,480,543, 8,556,787, D551,725, D581,996, D617,855, D650,025, D650,026 and D664,220. An object of the present invention is to provide new and improved inversion apparatus.

SUMMARY OF THE INVENTION

Generally speaking, the present invention may be described as improvements to inversion apparatus that support a user in an inverted position relative to an underlying floor surface. The improvements may be practiced individually and/or in various combinations.

One improvement may be described in terms of an inversion table support frame having left and right frame members configured to movably support the inversion table; left and right front legs having respective upper ends connected to respective left and right frame members, and respective lower ends configured to bear against an underlying floor surface; left and right rear legs having respective upper ends connected to respective left and right frame members, and respective lower ends configured to bear against an underlying floor surface; and a foot platform mounted on the lower ends of the front legs to accommodate the feet of a person mounting the inversion apparatus.

Inversion table support frames falling within the scope of the present invention may also be described in terms of left and right frame members configured to movably support the inversion table therebetween; generally L-shaped left and right front legs having respective upper segments connected to respective left and right frame members, and respective lower segments configured to bear against an underlying floor surface; and left and right rear legs having respective upper ends connected to respective left and right frame members, and respective lower ends configured to bear against an underlying floor surface.

Inversion table support frames falling within the scope of the present invention may also be described in terms of a left frame member and a right frame member configured and arranged to movably support the inversion table therebetween; a left first leg and a right first leg, each having an upper end connected to a respective frame member, and a lower end configured to bear against an underlying floor surface; and a left second leg and a right second leg, each having a respective upper end pivotally connected to a respective frame member for pivoting about a common pivot axis, and a lower end configured to bear against an underlying floor surface, wherein the left frame member defines a stop configured and arranged to limit pivoting of the left second leg away from the left first leg.

Another improvement may be described in terms of a water bottle holder connected to an inversion table support frame. The bottle holder has an upper portion secured between inner and outer frame members, and a lower portion sized and configured to receive a water bottle having an outside diameter of at least three inches.

Various features and benefits of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 11:
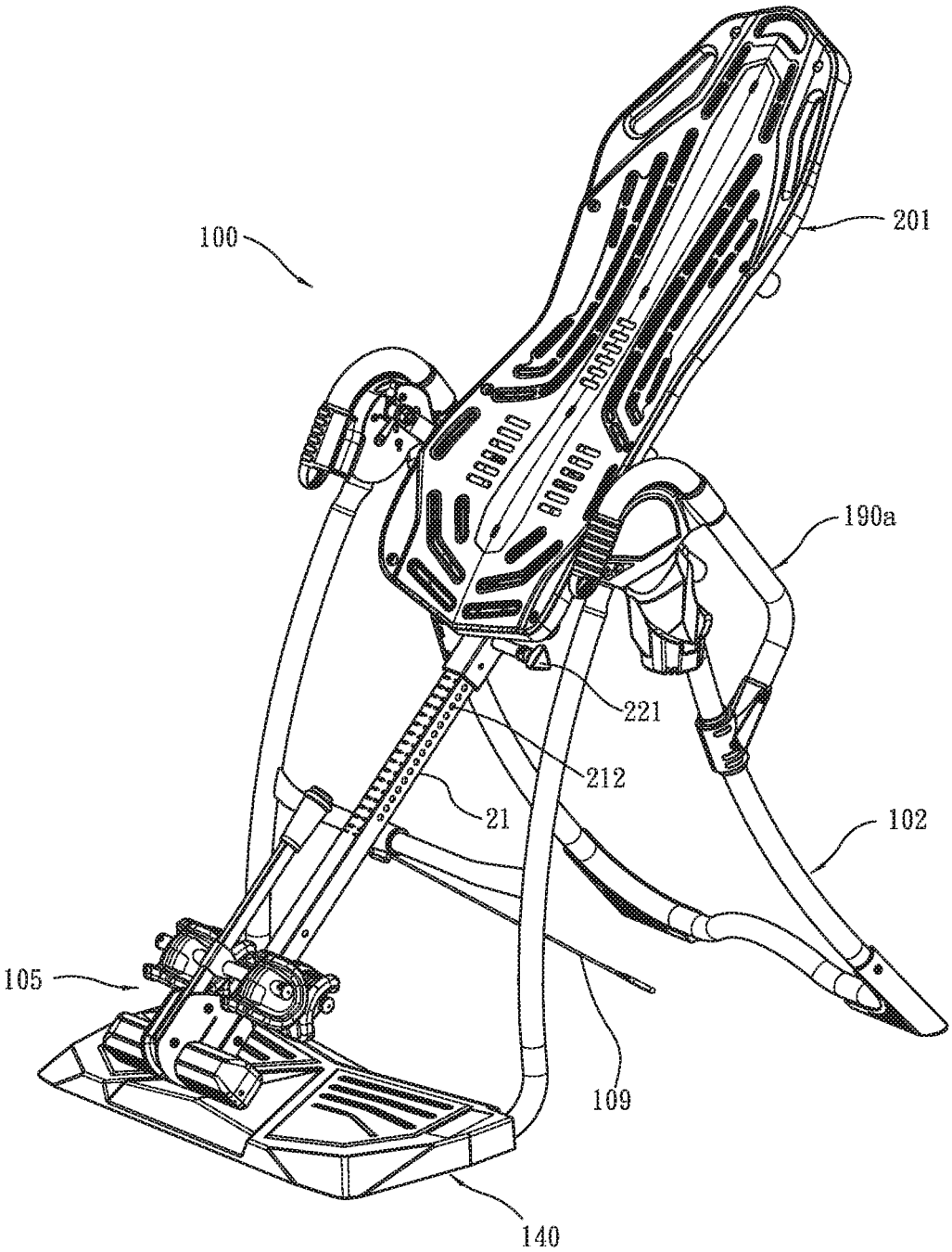
FIG. 11 is a perspective view of an inversion apparatus constructed according to the principles of the present invention and including the support frame of FIG. 1 and the inversion table of FIG. 8.
Figure 12:
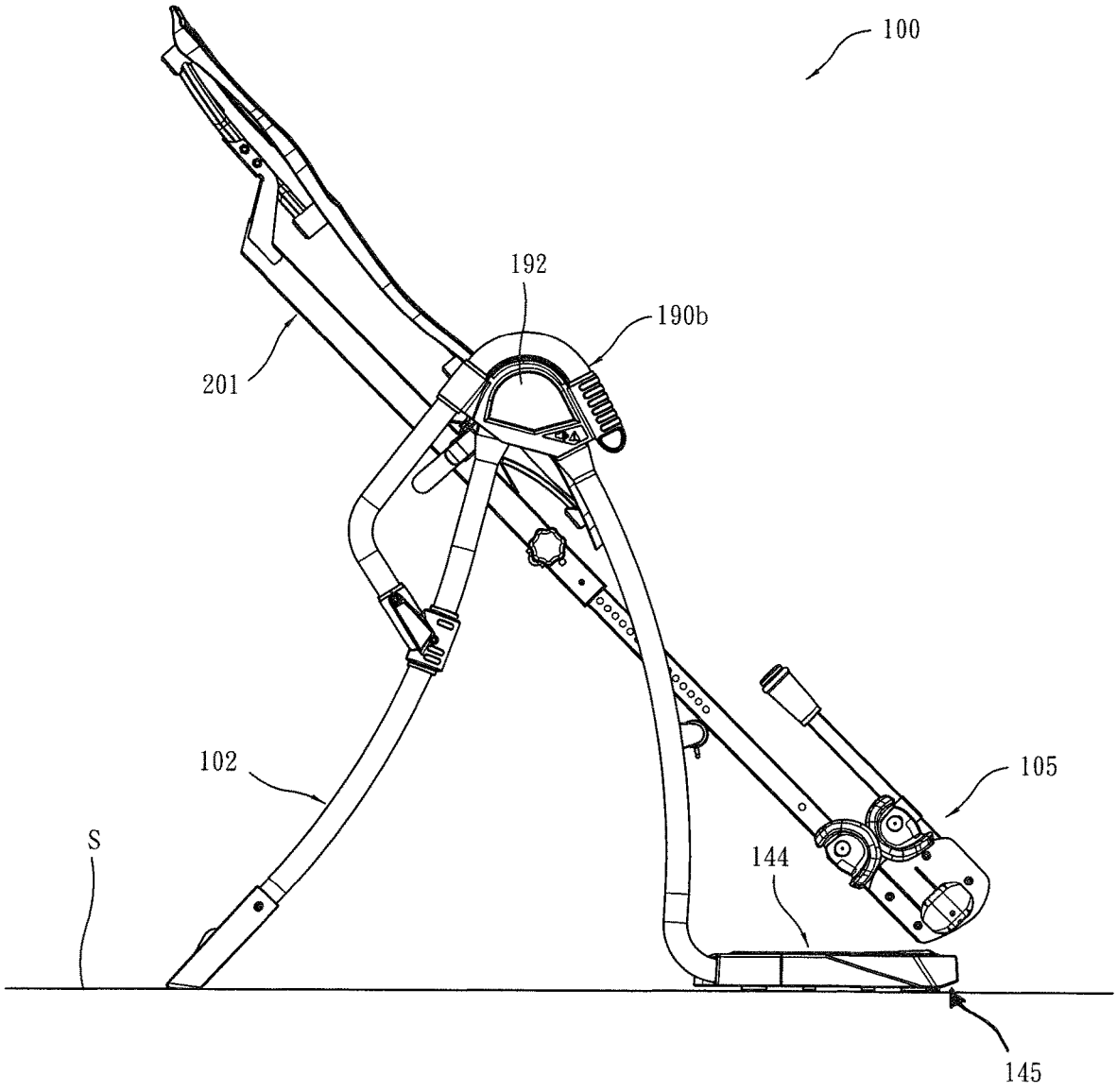
FIG. 12 is a side view of the inversion apparatus of FIG. 11 with the support frame arranged into the deployed configuration as shown in FIG. 1.
Figure 13:
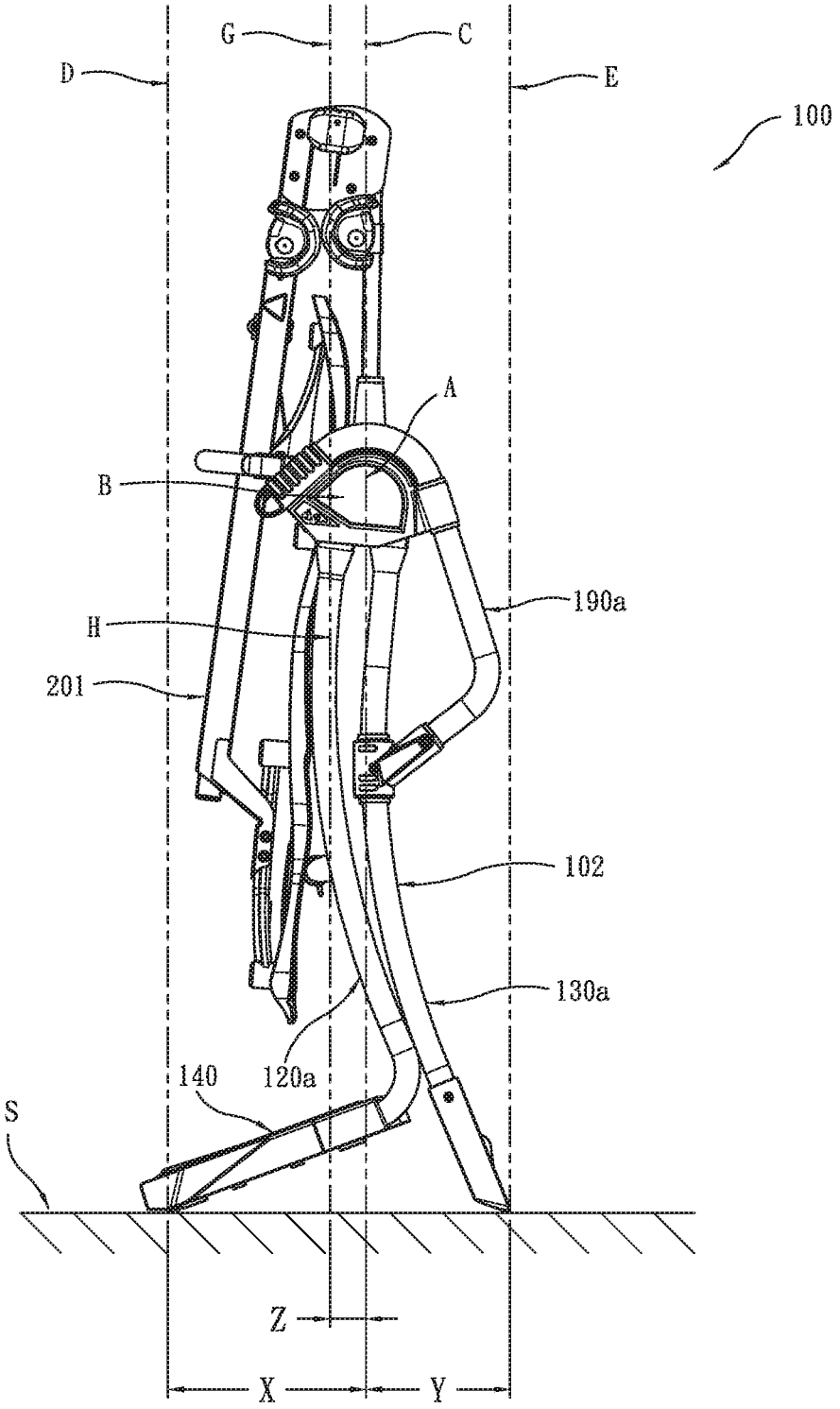
FIG. 13 is an opposite side view of the inversion apparatus of FIG. 11 with the support frame rearranged into a storage configuration.

FIGS. 11-13 show a preferred embodiment inversion apparatus 100 constructed according to the principles of the present invention. The apparatus 100 shares attributes with and/or may be implemented with components from one or more of the inversion apparatus disclosed in U.S. Pat. Nos.

5,967,951, 7,052,448, 7,663,653, 7,118,518, 7,125,372, 7,507,192, 7,544,157, 7,585,264, 7,625,326, 7,625,327, 7,867,154, 8,051,512, 8,291,533, 8,480,543, 8,556,787, D551,725, D581,996, D617,855, D650,025, D650,026 and D664,220, all of which are incorporated herein by reference.

The inversion apparatus 100 supports a user in an inverted position relative to an underlying floor surface S. The inversion apparatus 100 includes a support frame 102 that pivotally supports an inversion bed or table 201 at an elevation above the floor surface S. FIGS. 11-12 show the inversion apparatus 100 in a deployed or operative configuration, while FIG. 13 shows the inversion apparatus 100 in a retracted or storage configuration. When deployed for use, the inversion table 201 supports a user while pivoting through a range of orientations relative to the floor surface S, from approximately upright to completely upside down. This disclosure focuses on various features of the inversion apparatus 100 with the understanding that other features may be gleaned from the above-referenced patents.

Generally speaking, the support frame 102 includes left and right frame members 110*a* and 110*b*; left and right front legs 120*a* and 120*b*; and left and right rear legs 130*a* and 130*b*. FIGS. 1, 7 and 11-13 show left and right grab bars or handlebar assemblies 190*a* and 190*b* fastened to the frame 102, while FIGS. 2-5 show the frame 102 with the left and right handlebar assemblies 190*a* and 190*b* removed. The handlebar assemblies 190*a* and 190*b* may be described as separate parts or alternatively, as parts of the frame 102. Unless otherwise specified, the structural components of the frame 102 are preferably cylindrical steel tubes, portions of which may be bent and/or crushed for fabrication purposes. The support frame 102 is symmetrical about a plane of symmetry extending through the center of the frame 102 and perpendicular to the drawing sheets of FIGS. 4-5.

Each frame member 110*a* and 110*b* is a steel plate configured to movably support a respective side of the inversion table 201. The frame members 110*a* and 110*b* are mirror images of one another (relative to the plane of symmetry), and are shown in the most detail in FIG. 6. In a manner already known in the art, each frame member 110*a* and 110*b* defines an upwardly opening slot 111 to receive a respective rod or trunnion on the table 201. The left and right trunnions nest concentrically in the semi-circular bottoms of respective slots 111 for rotation about a common pivot axis (designated as A in FIG. 13). Spring loaded hooks or latches 112 are movably mounted on respective frame members 110*a* and 110*b* and biased to close off the upper ends of the slots 111 and thereby block unintentional removal of the trunnions from the slots 111.

The left and right front legs 120*a* and 120*b* have respective upper ends connected to respective left and right frame members 110*a* and 110*b* via respective nuts and bolts 121 for selective pivoting about a common pivot axis (designated as B in FIG. 13). FIG. 13 shows the front legs 120*a* and 120*b* pivoted to an extreme rearward or closed position, while FIGS. 11-12 show the front legs 120*a* and 120*b* pivoted to an extreme forward or open position. As most clearly shown in FIG. 13, the extreme rearward position is defined by contact with the rear legs 130*a* and 130*b*, proximate the lower ends thereof.

Figure 6:
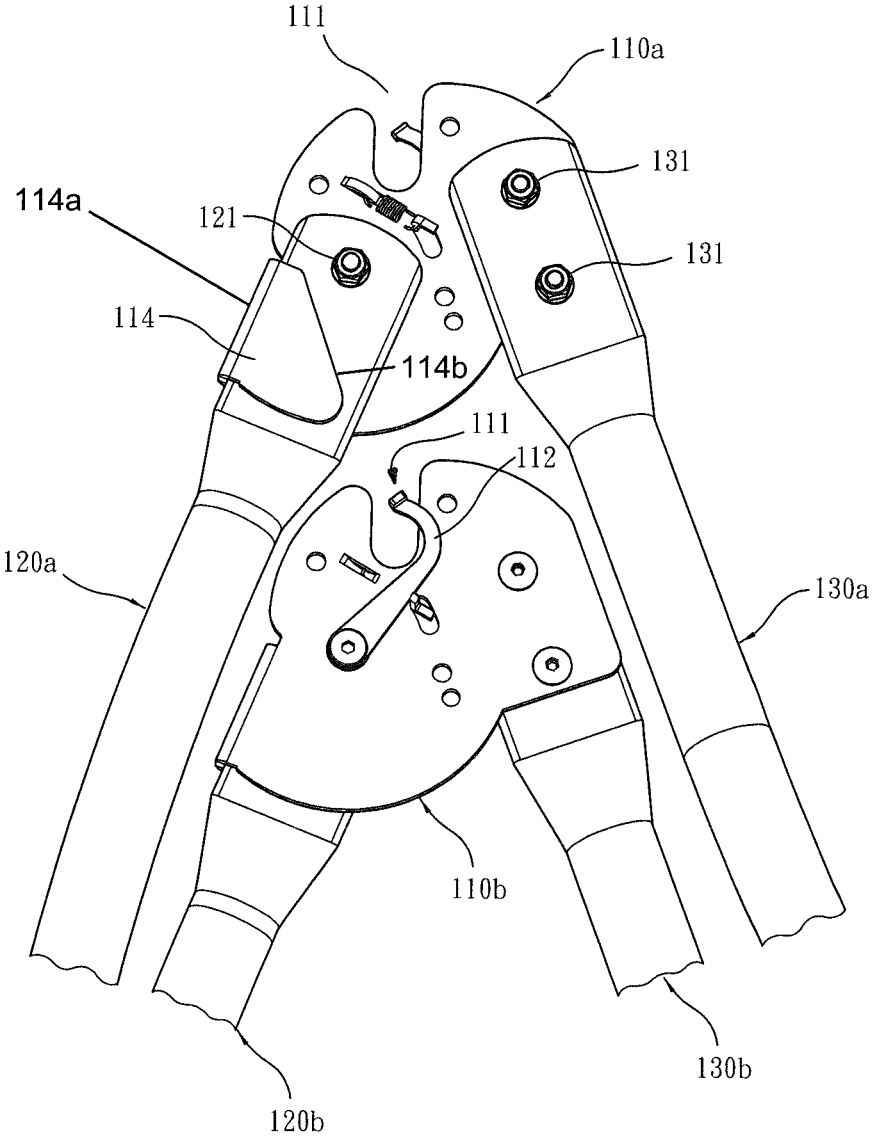
FIG. 6 is a partial perspective view of upper portions of the support frame of FIG. 2 (with the left side of the frame in the foreground)

As most clearly shown in FIG. 6, the extreme forward position of the front legs 120*a* and 120*b* is defined by a stop 114 on each frame member 110*a* and 110*b*. Each stop 114 may be described as a bent or folded over flange or a U-shaped flange on a respective frame member 110*a* or 110*b*. A distal end of each flange overlies an outboard side of a respective leg 120*a* or 120*b*, while an intermediate portion of each flange, defined between two ninety degree bends, overlies a forward edge of a respective leg 120*a* or 120*b* (to prevent forward pivoting beyond the extreme forward position). An opposite or proximate end of each flange may be described as an integral portion or primary body of the metal plate. The distal ends of the stop or U-shaped flange 114 define an open end 114*b* and the intermediate portion of the stop 114 defines a closed end 114*a* Each open end 114*b* opens toward the respective front leg 120*a* or 120*b*, and the front leg 120*a* or 120*b* is pivotal away from the respective rear leg 130*a* or 130*b* until the respective front leg 120*a* or 120*b* reaches the closed end 114*a* of the stop 114.

The left and right front legs 120*a* and 120*b* have respective intermediate portions that are curved in a manner that may be described as forwardly convex, and that extend more vertically than horizontally. The left and right front legs 120*a* and 120*b* have respective lower ends that may be described as straight, and that extend more horizontally than vertically. In this regard, a ninety degree bend is formed in each front leg 120*a* and 120*b* at a juncture between a respective intermediate portion and a respective lower end, thereby configuring and arranging each lower end to bear against (and extend parallel to) the underlying floor surface S when deployed as shown in FIGS. 11-12. As a result, each front leg 120*a* and 120*b* may be described as generally L-shaped when viewed from the left or right side.

A bar 129 is rigidly interconnected between the intermediate portions of the front legs 120*a* and 120*b* for purposes already known in the art. In this regard, the bar 129 limits pivoting of the bed 201 toward a vertically upright orientation, as shown in FIG. 12, and the bar 129 anchors one end of a strap 109 that is selectively adjustable in length and selectively connected to the bed 201 to limit pivoting of the bed 201 toward a vertically upside down position.

Figure 5:
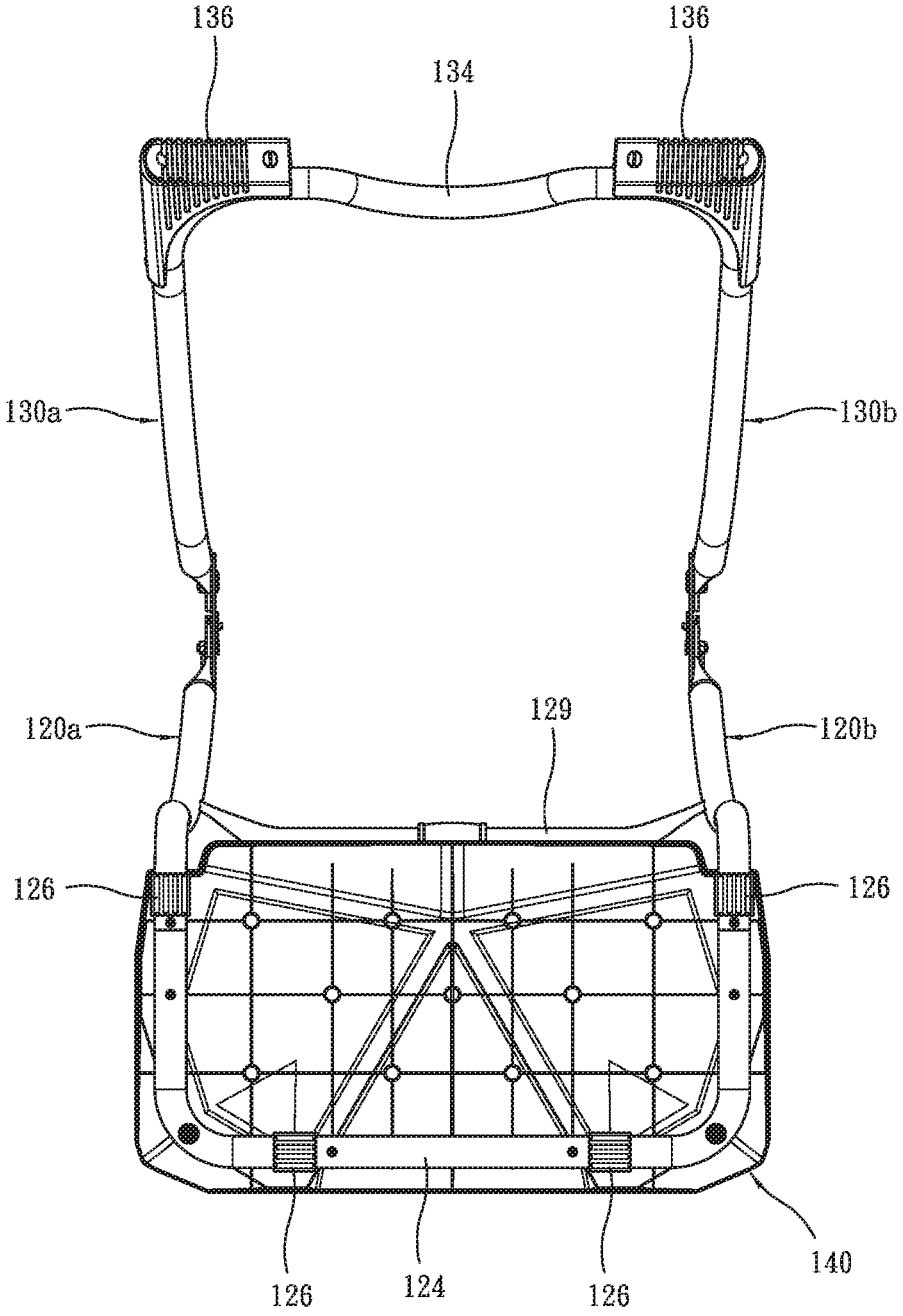
FIG. 5 is a bottom view of the support frame of FIG. 2.

As shown in FIG. 5, a lower bar 124 is rigidly interconnected between the lower ends of the front legs 120*a* and 120*b*. As a result, the front legs 120*a* and 120*b* may also be described as a single or unitary front leg, with ninety degree bends formed in this unitary front leg at junctures between the lower ends of the front legs 120*a* and 120*b* and the lower bar 124. Alternatively, the lower ends of the front legs 120*a* and 120*b* may be described as cooperating with the lower bar 124 to define a single or unitary U-shaped member or lower front end. Feet or pads 126 made of rubber or another suitable material known in the art may be affixed to downwardly facing portions of the U-shaped member to decrease wear and tear on the floor surface S and/or increase friction relative to the floor surface S. A foot platform 140 is rigidly mounted on top of the U-shaped member (and the feet 126), and may be described as a separate part or alternatively, as a part of the frame 102.

As shown in FIG. 5, the foot platform 140 spans a gap or distance defined between the left and right front legs 120*a* and 120*b*. The foot platform 140 is preferably made of rigid plastic and fastened to the front legs 120*a* and 120*b* by screws inserted upward through holes in the front legs 120*a* and 120*b* and threaded into aligned downwardly opening holes in the foot platform 140. As shown in FIG. 12, the foot platform 140 defines an upwardly facing foot supporting surface 144 that extends parallel to the floor surface S when the frame 102 is deployed for use, as shown in FIGS. 11-12. Among other things, the foot supporting surface 144 is sized and configured to support the feet of a standing person in a manner that both helps him properly orient himself relative to the apparatus 100 and provides a flat and stable support surface for mounting and dismounting the bed 201. In addition, the foot platform 140 defines an opposite, downwardly facing surface that engages the floor surface S when the apparatus 100 is arranged as shown in FIG. 12, and an angled surface 145 that engages the floor surface S when the apparatus 100 is arranged as shown in FIG. 13.

With reference back to FIG. 6, the left and right rear legs 130*a* and 130*b* have respective upper ends rigidly connected or fastened to respective left and right frame members 110*a* and 110*b* via respective nuts and bolts 131. The rear legs 130*a* and 130*b* have respective intermediate portions, which are relatively more curved than the intermediate portions of the front legs 120*a* and 120*b*, and which may be described as rearwardly concave and/or as extending more vertically than horizontally. The rear legs 130*a* and 130*b* have respective lower ends configured to bear against the floor surface S.

Figure 1:
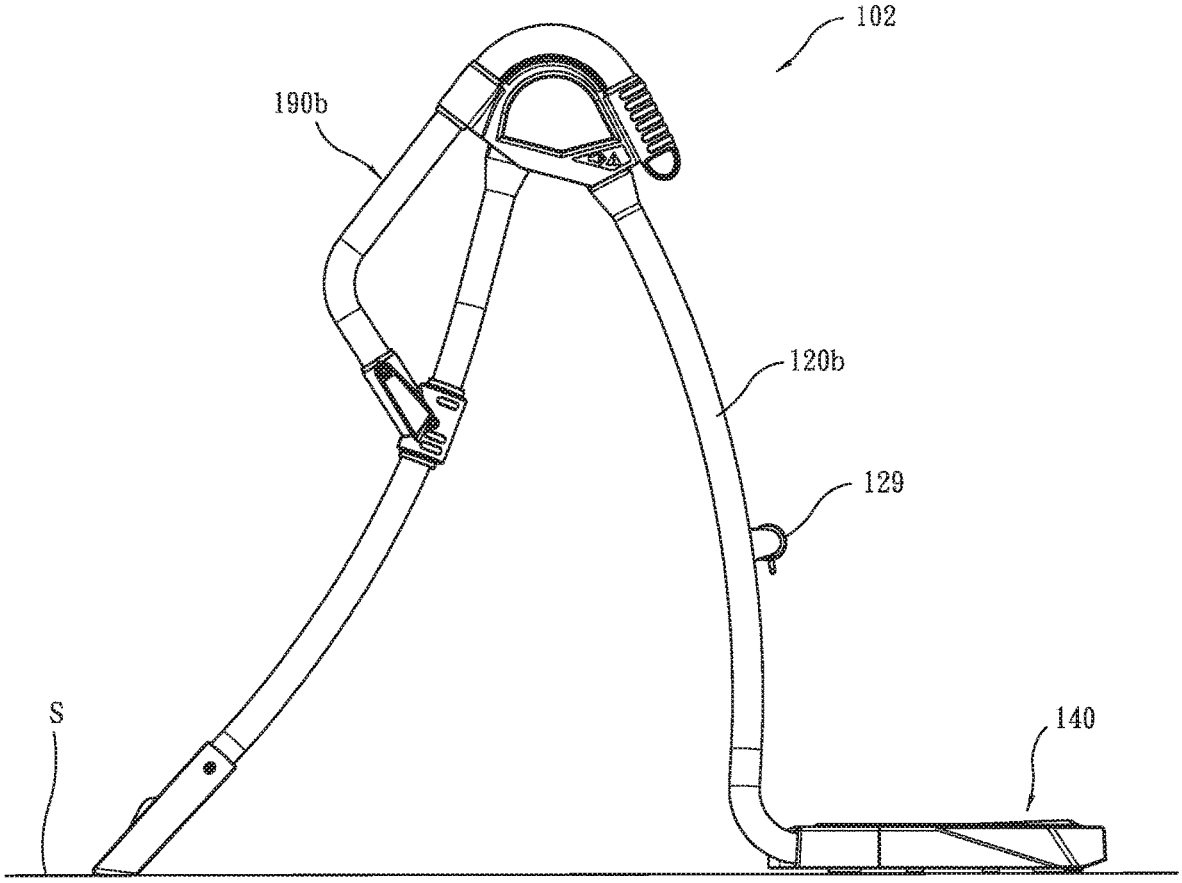
FIG. 1 is a right side view of an inversion table support frame constructed according to the principles of the present invention and arranged in a deployed or operative configuration relative to an underlying floor surface (the opposite, left side view is a mirror image thereof)
Figure 2:
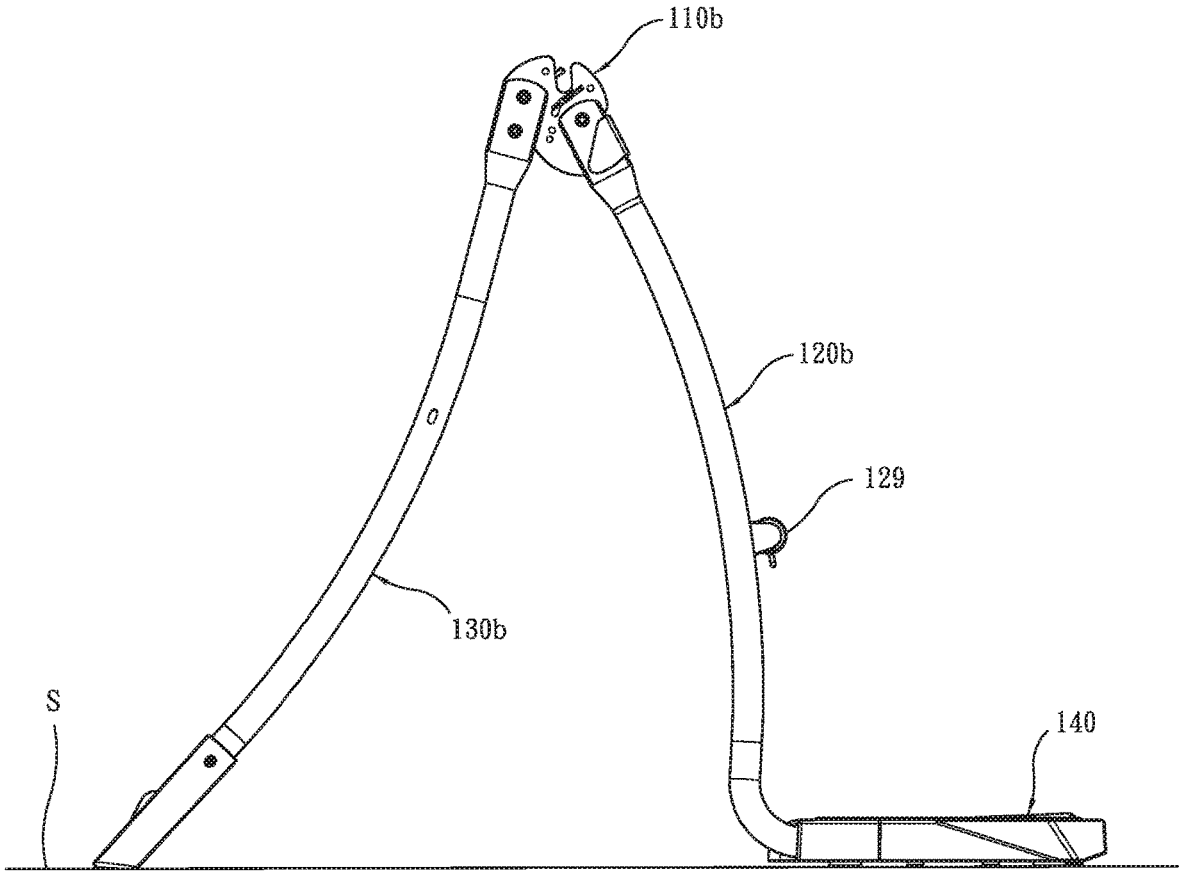
FIG. 2 is a right side view of the support frame of FIG. 1 with certain components removed to reveal other components (the opposite, left side view is a mirror image thereof)
Figure 3:
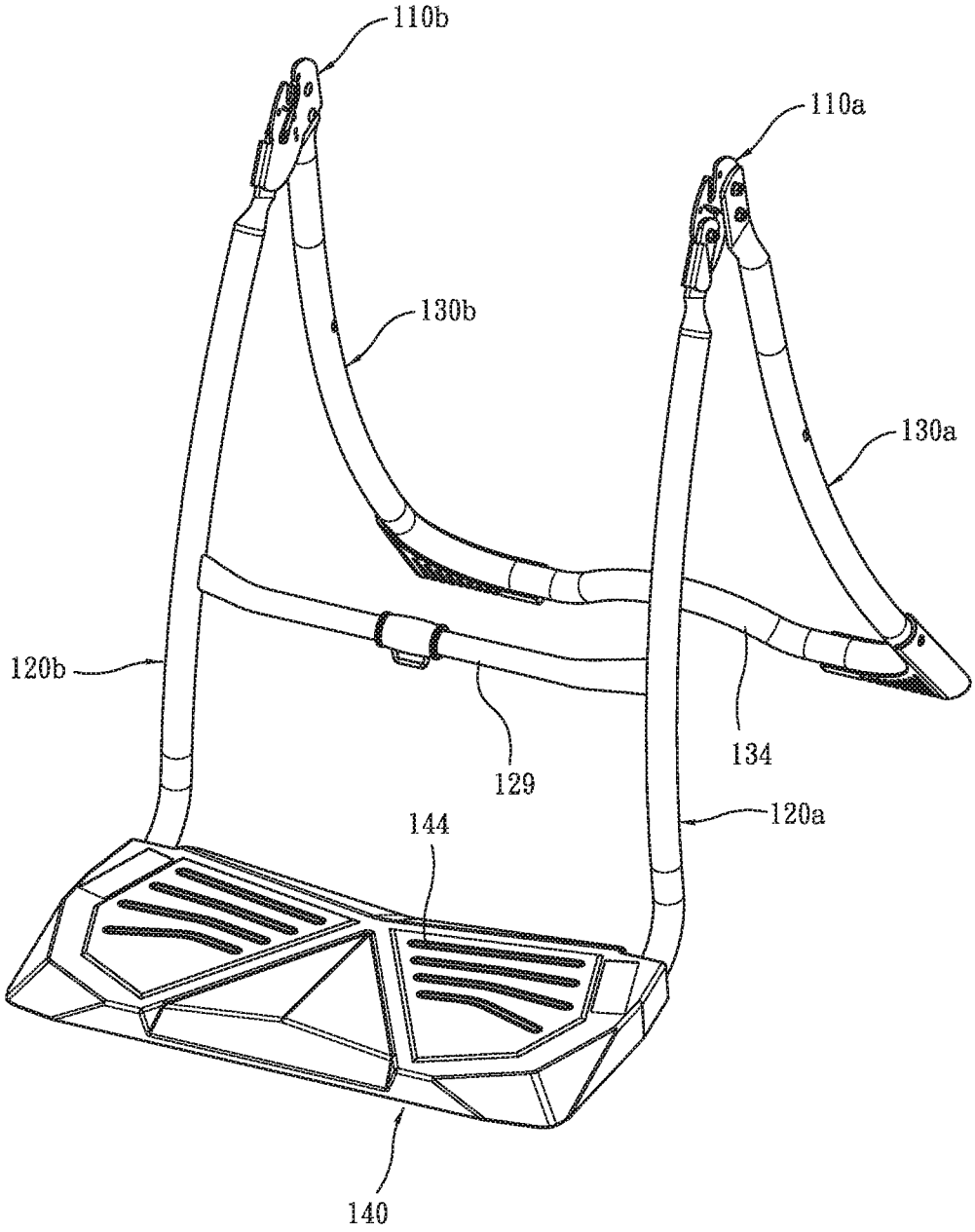
FIG. 3 is a perspective view of the support frame of FIG. 2 (with the front of the frame in the foreground)
Figure 4:
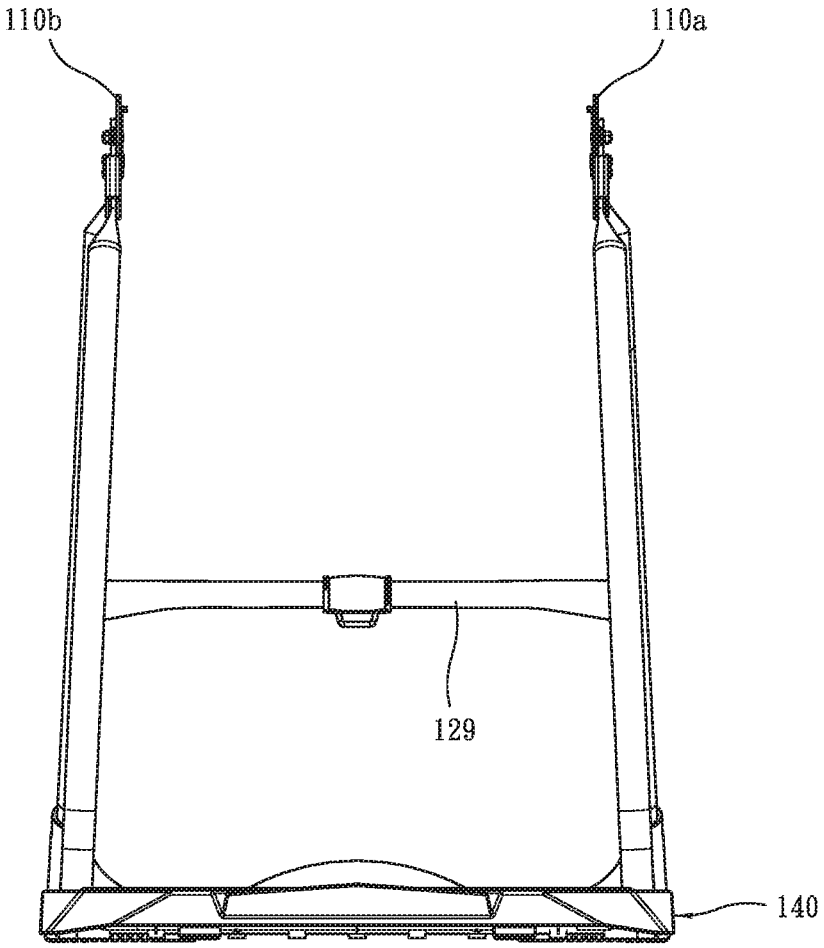
FIG. 4 is a front view of the support frame of FIG. 2.

As shown in FIGS. 3 and 5, a lower bar 134 is rigidly interconnected between the lower ends of the rear legs 130*a* and 130*b*. As a result, the rear legs 130*a* and 130*b* may also be described as a single or unitary rear leg, with ninety degree bends formed in this unitary rear leg at junctures between the lower ends of the rear legs 130*a* and 130*b* and the lower bar 134. Alternatively, the lower ends of the rear legs 130*a* and 130*b* may be described as cooperating with the lower bar 134 to define a single or unitary U-shaped member or lower rear end. Feet or pads 136 made of soft plastic or another suitable material known in the art are preferably affixed to downwardly facing corners of the U-shaped member to decrease wear and tear on the floor surface S and/or increase friction relative to the floor surface S.

Figure 7:
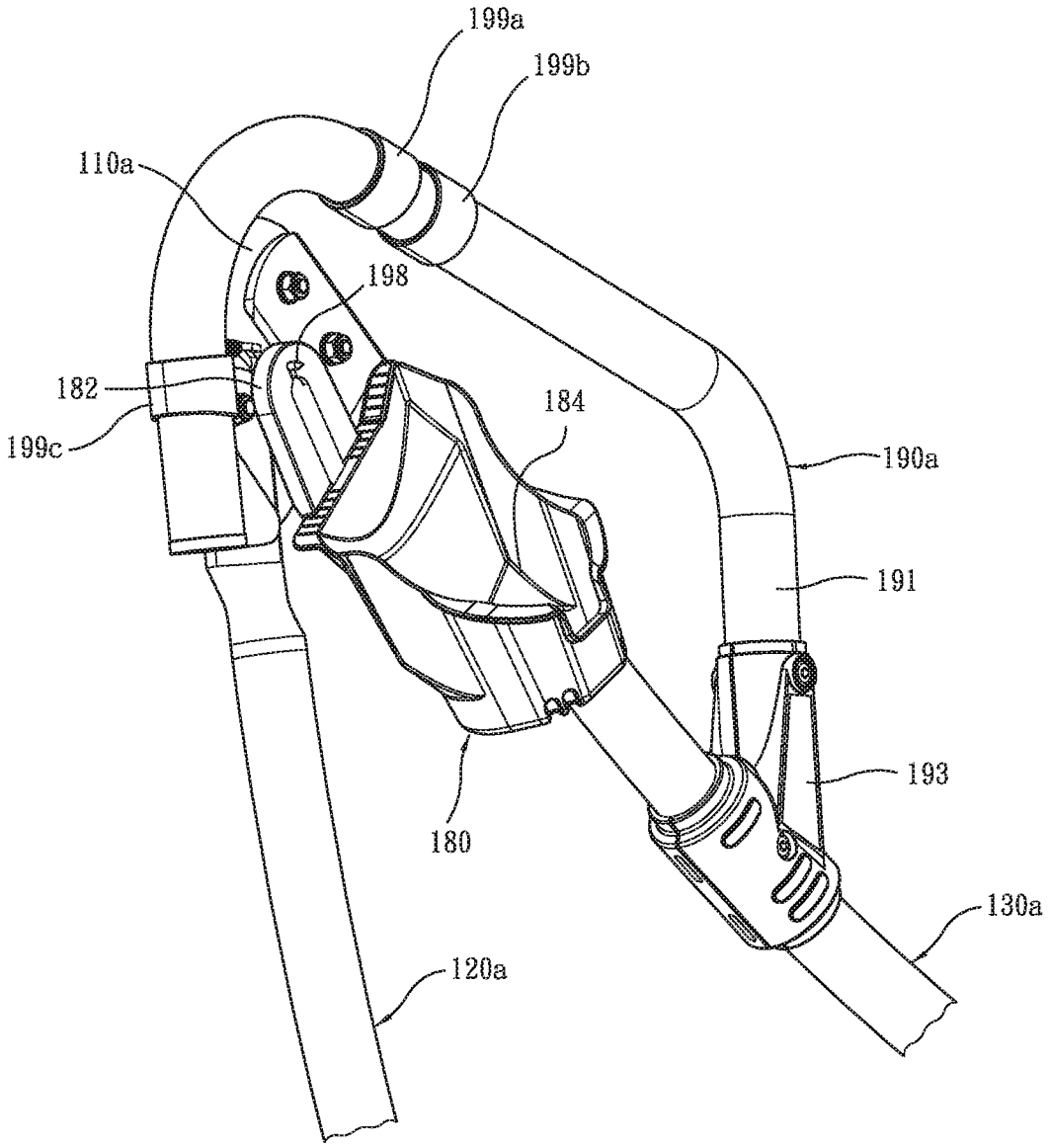
FIG. 7 is a partially fragmented perspective view of an optional water bottle holder connected to one of the upper portions of the support frame shown in FIG. 6.

FIG. 12 shows a right cover or finish member 192 associated with the right handlebar assembly 190*b*, and a mirror image of the cover member 192 is associated with the left handlebar assembly 190*a*. FIG. 7 shows the left handlebar assembly 190*a* with the cover member 192 removed. The assembly 190*a* includes a steel tube 191 that is bent in two locations. Plastic rings 199*a-c* are mounted on the tube 191 to accommodate over-molding of the cover member 192 onto the tube 191. A first or forward end of the tube 191, including the rings 199*c*, is capped by a respective cover member 192 during the over-molding process. Similarly, an intermediate portion of the tube 191, including the rings 199*a-b*, is encircled by a respective cover member 192 during the over-molding process. A second or rearward end of the tube 191 is affixed to the rear right leg 130*a* via a separate plastic part or juncture member 193. A first bend in the tube 191, through an arc of approximately 80 degrees, is disposed between the juncture member 193 and the ring 199*b*, as is a straight segment of the tube 191. A second bend in the tube 191, through an arc of approximately 100 degrees, is disposed between the ring 199*a* and the rind 199*c*. Three screws are inserted through a respective frame member 110*a* or 110*b* and threaded into a respective cover member 192 to secure the upper forward portion of the cover member 192 in place. The resulting handlebar assemblies 190*a* and 190*b* provide convenient gripping locations for the hands of a person maneuvering himself and the table 201 through different orientations relative to the frame 102.

An optional upwardly opening receptacle or water bottle holder 180 is provided on the inversion apparatus 100. As shown in FIG. 7, the holder 180 has an upper portion 182 that may be described as an inverted U-shaped member, and a lower portion that may be described in terms of side walls and a bottom wall that define an upwardly opening compartment 184. A screw 198 inserts through both the frame member 110*a* and the upper portion 182 of the holder 180 and threads into the cover member 192 (not shown in FIG. 7). As a result, the upper portion 182 extends downward through a downwardly opening slot defined between the cover member 192 and the frame member 110*a*, and the compartment 184 is disposed beneath the cover member 192 and within arm's reach of a person using the apparatus 100.

Figure 8:
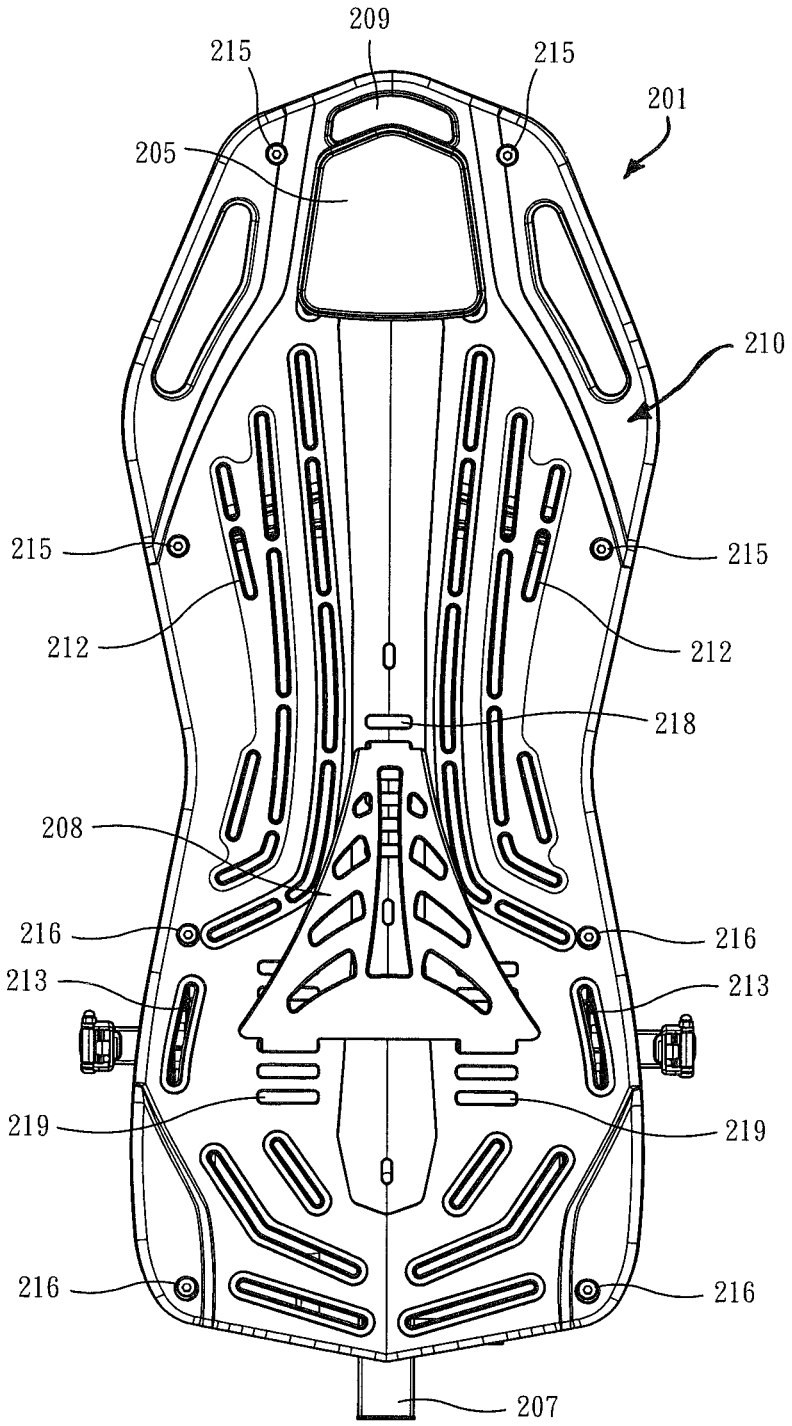
FIG. 8 is a top view of an inversion table (excluding a leg extension component) suitable for mounting on the support frame of FIG. 1.
Figure 9:
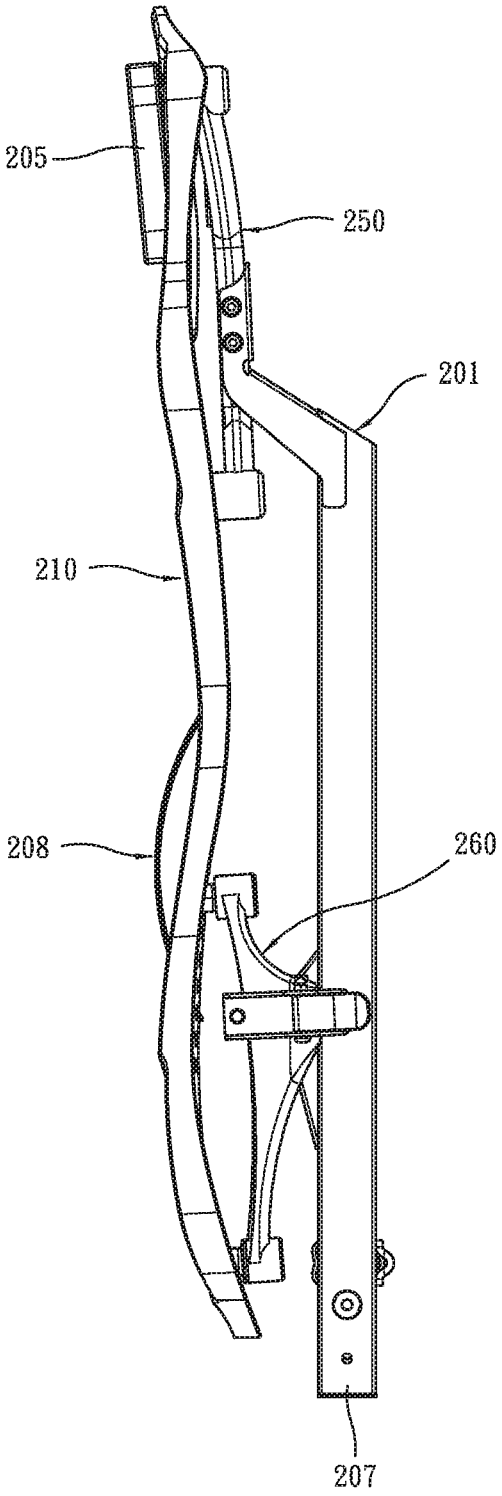
FIG. 9 is a side view of the inversion table of FIG. 8.
Figure 10:
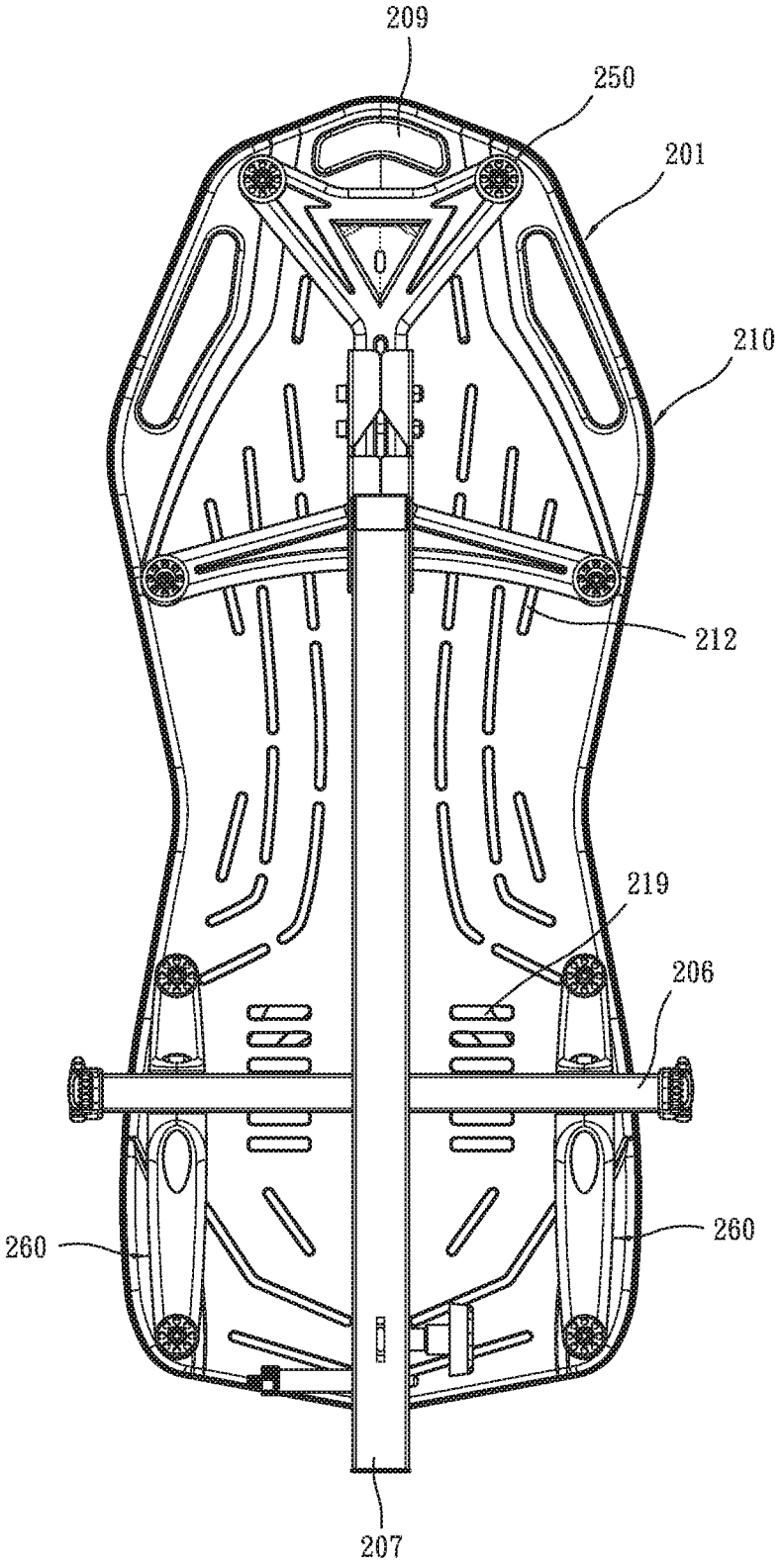
FIG. 10 is a bottom view of the inversion table of FIG. 8.

FIGS. 8-10 show and/or reference various details of the bed or table 201. The bed 201 includes a body engaging platform 210 made of injection molded plastic. As shown in FIGS. 9-10, the platform 210 is supported by underlying ribs or brackets 250 and 260 (also made of injection molded plastic). More specifically, four fasteners 215 insert through holes in the upper half of the platform 210 and aligned holes in an upper bracket 250, and four fasteners 216 insert through holes in the lower half of the platform 210 and aligned holes in respective left and right lower brackets 260. A cross bar 206, preferably a square steel tube, is interconnected between the left and right brackets 260, and a longitudinal bar 207, preferably a square steel tube, is interconnected between the cross bar 206 and the upper bracket 250.

The extension or lower leg support 21 has an upper end that is secured inside the longitudinal bar 207 in a manner known in the art. In this regard, the upper end of the extension 21 slides or telescopes inside the bar 207, and is selectively latched in place by a spring-loaded pin or plunger assembly 221 that inserts through a hole in the bar 207 and an aligned hole 212 in the extension 21. The extension 21 has an opposite, lower end that supports a leg engaging assembly 105 to support/restrain a user's feet/ankles in a manner known in the art.

Proximate a head end or upper end of the platform 210, an opening 209 extends through the platform to provide a hand grip. Just beneath this opening 209, a head pad 205 is releasably mounted on the platform 210, preferably by means known in the art, such as hook-and-loop fasteners, for example. Additional left and right hand grips are provided along the periphery of the platform 210 to the respective left and right sides of the head pad 205.

The platform 210 is symmetrical relative to a plane extending through the longitudinal axis of the longitudinal bar 207 (and perpendicular to the drawings sheet of FIGS. 8 and 10). Near the center of the platform 210, laterally arranged slots 218 extend through the platform 210 (and across this plane of symmetry). Further down, laterally arranged arrays of left and right slots 219 extend through the platform 210 (on respective sides of the plane of symmetry). In a manner known in the art, the slots 219 and 218 cooperate to releasably support a lumbar bridge 208 in any of several arrangements on the platform 210. The bow or curvature of the lumbar bridge 208 is determined by distance between the slots 218 and 219 engaged by respective ends of the lumbar bridge 208. In other words, the lumbar bridge 208 must be bent to a greater extent to fit into first and second slots 218 and 219 that are relatively closer to one another.

Additional slots of various shapes and lengths extend through the platform 210 at various locations. These slots include left and right slots 212 that extend through the platform 210 proximate a lower end of the upper bracket 250, and left and right slots 213 that extend through the platform 210 proximate the upper ends of the lower brackets 260.

FIG. 13 shows the apparatus 100 standing in a stable folded or storage configuration on the floor surface S. To arrive at this configuration, the leg extension 21 has been telescopically inserted as far as allowed into the upper end of the table 201, so the table 201 could be pivoted approximately 180 degrees in a counter-clockwise direction (past the bar 129). In this configuration, the center of gravity is designated as H and the "fore to aft" center of gravity (left to right in FIG. 13) is represented by the line G. The pivot axis A is intersected by a line C, which extends parallel to the line G and perpendicular to the floor surface S. The distance Z from line C to line G is approximately 2.4 inches. A line D extends parallel to the lines C and G, and intersects the floor surface S at a point of contact with the front portion of the frame 102. The distance X from line D to line C is approximately 12.3 inches and may described as at least 12 inches and/or as between 10 and 14 inches. A line E extends parallel to the line D, and intersects the floor surface S at a point of contact with the rear portion of the frame 102. The distance Y from line E to line C is approximately 8.1 inches and may described as at least 6 inches and/or as between 6 and 10 inches. The term "approximately" is used herein to indicate plus or minus ten percent of a stated dimension.

Taking into account the 2.4 inch distance between line C and line G, the line G is approximately 10 inches "rearward" of the line D, and the line G is approximately 10.5 inches "forward" of the line E. In this regard, the center of gravity line G may be described as approximately centered between the front and rear contact points between the frame 102 and the floor S. The center of gravity line G may also be described as at least 5 inches from a point of contact between the front of the frame 102 and the floor surface S, and as at least 5 inches from a contact point between the rear of the frame 102 and the floor surface S.

FIG. 13 also illustrates that portions of the front legs 120*a* and 120*b* are disposed behind both the center of gravity line G and the pivot axis A when the apparatus 100 is arranged in its storage configuration. Also, a majority of the apparatus 100 (and all of the apparatus 100 above the floor engaging members at the bottom of the frame 102) is disposed between the lines D and E extending vertically upward from points of contact between the frame 102 and the floor surface S. When the apparatus 100 is arranged as shown in FIG. 13, the foot platform 140 occupies an angled orientation relative to the floor surface S, and a forward edge of the foot platform 140 engages the floor surface S, and the surface 145 on the foot platform 140 lies flat against the floor surface S. On the other hand, when the apparatus 100 is arranged in its operative configuration, as shown in FIG. 12, the foot platform 140 occupies a horizontal or parallel orientation relative to the floor surface S, and a bottom edge of the foot platform 140 engages and lies flat against the floor surface S (while the surface 145 defines an acute angle relative to the floor surface S).

The subject invention may also be described as follows:

In one example, an inversion apparatus that supports a user in an inverted position relative to an underlying floor surface comprises an inversion table, left and right frame members, left and right front legs, left and right rear legs, and a foot platform. The inversion table has opposite left and right sides and defines a back supporting surface sized and configured to support a user's back. The left and right frame members are configured to movably support respective said sides of the inversion table. The left and right front legs have respective upper ends connected to respective said left and right frame members and respective lower ends configured to bear against an underlying floor surface. The left and right rear legs have respective upper ends connected to respective said left and right frame members and respective lower ends configured to bear against an underlying floor surface. The foot platform is mounted on the lower ends of the front legs, and the foot platform is configured and arranged to accommodate the feet of a person standing in a position ready to mount the inversion apparatus.

Optionally, the foot platform spans a gap defined between the front legs.

Optionally, the foot platform defines a foot supporting surface that extends parallel to the floor surface.

Optionally, the front legs are pivotally connected to respective said frame members for pivoting about a common axis. Optionally, at least one of the frame members defines a stop to limit pivoting of at least one of the front legs away from a respective one of the rear legs. Optionally, the stop is a U-shaped member configured and arranged to receive said one of the front legs. The rear legs are rigidly connected to the left and right frame members. Optionally, the foot platform cooperates with the rear legs to support the inversion apparatus in a stable upright position on the floor surface when the front legs are pivoted into a compact configuration relative to the rear legs.

Optionally, a bar is rigidly interconnected between the front legs proximate the lower ends thereof, and the front legs and the bar cooperate to define a U-shaped segment that extends parallel to the floor surface when the inversion apparatus is in an operative configuration on the floor surface, and the foot platform covers the U-shaped segment from above.

Optionally, each of the front legs is generally L-shaped when viewed from a left side of the inversion apparatus, with a primarily horizontal portion extending parallel to the floor surface, and a primarily vertical portion extending between a respective said horizontal portion and a respective one of the frame members.

In another example, an inversion apparatus that supports a user in an inverted position relative to an underlying floor surface comprises an inversion table, left and right frame members, left and right front legs and left and right rear legs. Optionally, the inversion table has opposite left and right sides and defines a back supporting surface sized and configured to support a user's back. Optionally, the left and right frame members are configured to movably support the inversion table therebetween. Optionally, the left and right front legs are generally L-shaped and have respective upper segments connected to respective left and right frame members and respective lower segments configured to bear against an underlying floor surface. Optionally, the left and right rear legs have respective upper ends connected to respective left and right frame members and respective lower ends configured to bear against an underlying floor surface.

Optionally, a foot platform is fastened to the lower ends of the front legs, wherein the foot platform is configured and arranged to accommodate the feet of a person mounting the inversion apparatus. Optionally, the foot platform spans a gap defined between the lower ends of the left and right front legs.

Optionally, the lower segments of the front legs have forwardmost portions that cooperate with the rear legs to support the inversion apparatus in a stable upright position on the floor surface when the front legs are pivoted into a compact configuration relative to the rear legs. Optionally, a bar is rigidly interconnected between the forwardmost portions of the front legs. Optionally, the foot platform is rigidly mounted on top of the bar. Optionally, the lower segments of the front legs and the bar cooperate to define a U-shaped member that occupies a parallel orientation relative to the floor surface when the inversion apparatus is in an operative configuration on the floor surface, and a skewed orientation relative to the floor surface when the inversion apparatus is in the compact configuration.

In another example, an inversion apparatus that supports a user in an inverted position relative to an underlying floor surface comprises an inversion table, left and right frame members, left and rear legs, left and right front legs, and left and right grab bars. The inversion table has a left side and a right side. The left frame member and the right frame member are each configured and arranged to movably support a respective said side of the inversion table. The left rear leg and the right rear leg each have a respective upper end connected to a respective said frame member and a respective lower end configured to bear against an underlying floor surface. The left front leg and the right front leg each have a respective upper end pivotally connected to a respective said frame member for pivoting about a common pivot axis and a respective lower end configured to bear against an underlying floor surface. The left grab bar and the right grab bar each have a respective first end portion connected to a respective said rear lea, a respective second end portion connected to a respective said frame member, and a respective intermediate portion disposed therebetween. The intermediate portion defines a handle sized and configured for grasping in a user's respective hand at a distance from a respective said rear leg.

Optionally, on the right grab bar, the first end portion, the second end portion, and the intermediate portion may cooperate to define a U-shaped configuration with a first bend defined between the first end portion and the intermediate portion and a second bend defined between the second end and the intermediate portion. Optionally, at least one of the first bend and the second bend is more than ninety degrees. Optionally, the first end portion and the second end portion extend in convergent fashion from the intermediate portion.

Optionally, a left member is interconnected between the left grab bar and the left frame member and a right member is interconnected between the right grab bar and the right frame member, wherein the left member shrouds a left side view of (a) a point of connection between the upper end of the left rear leg and the left frame member, and (b) a point of connection between the upper end of the left front leg and the left frame member. Optionally, the left member shrouds a top view of (a) the point of connection between the upper end of the left rear leg and the left frame member and (b) the point of connection between the upper end of the left front leg and the left frame member. Optionally, the left member and the left frame member cooperate to define a downwardly opening housing about the upper end of the left rear leg and about the upper end of the left front leg. Optionally, the left member has a forward portion connected to the second portion of the left grab bar, and a rearward portion connected to the intermediate portion of the left grab bar. Optionally, a bend in the left grab bar extends in an arc between the forward portion of the left member and the rearward portion of the left member. Optionally, the left grab bar is a cylindrical steel tube, and the forward portion of the left member forms a sleeve about the second portion of the left arab bar, and the rearward portion of the left member forms a sleeve about the intermediate portion of the left grab bar.

In another example, an inversion apparatus that supports a user in an inverted position relative to an underlying floor surface comprises an inversion table, left and right frame members, left and right first legs, and left and right second legs. The inversion table has a left side and a right side. The left frame member and the right frame member each are configured and arranged to movably support a respective said side of the inversion table. The left first leg and the right first leg each have a respective upper end connected to respective said frame member and a respective lower end configured to bear against an underlying floor surface. The left second leg and the right second leg each have a respective upper end pivotally connected to respective said frame member for pivoting about a common pivot axis and a respective lower end configured to bear against an underlying floor surface. The left frame member defines a stop configured and arranged to limit pivoting of the left second leg away from the left first leg.

Optionally, the stop is a U-shaped member configured and arranged to receive the left second leg.

In another example, an inversion apparatus that supports a user in an inverted position relative to an underlying floor surface comprises an inversion table, left and right frame members, a support frame, and a water bottle holder. The inversion table has a left side and a right side. The left frame member and the right frame member each are configured and arranged to movably support a respective said side of the inversion table. The support frame is configured to support the left frame member and the right frame member at an elevation above an underlying floor surface. The water bottle holder has an upper portion connected to the left frame member and a lower portion sized and configured to receive water bottle having an outside diameter of at least three inches.

Optionally, a left member is interconnected between the support frame and the left frame member, wherein the left member shrouds a left side view of a point of connection between the upper portion of the water bottle holder and the left frame member.

The subject invention may also be described in terms of methods with reference to the foregoing embodiments. For example, the subject invention may be described in terms of a method of transforming an inversion apparatus between an operative configuration standing upright on an underlying floor surface and a storage configuration standing upright on the underlying floor surface, comprising the steps of: providing an inversion apparatus having a frame that includes a front leg and a rear leg, a foot platform mounted on the front leg to accommodate a person's feet when the inversion apparatus occupies the operative configuration, and an inversion table movably mounted on the frame; moving the front leg away from the rear leg to arrive at the operative configuration, wherein the foot platform defines a first surface that engages the floor surface; and moving the front leg toward the rear leg to arrive at the storage configuration, wherein the foot platform defines a second surface that engages the floor surface, and the first surface is disposed above the floor surface.

The subject invention has been described with reference to preferred embodiments and particular applications with the understanding that persons skilled in the art will arrive at various modifications to the disclosed embodiments and/or their applications without departing from the scope of the subject invention. In view of the foregoing, the subject invention should be limited only to the extent of allowable claims that issue from this application or any related application.

What is claimed is:

1. An inversion apparatus that supports a user in an inverted position relative to an underlying floor surface, comprising:

an inversion table having opposite left and right sides and defining a back supporting surface sized and configured to support a user's back;

left and right frame members configured to movably support respective said sides of the inversion table;

left and right front legs having respective upper ends connected to respective said left and right frame members, and respective lower ends configured to bear against an underlying floor surface;

left and right rear legs having respective upper ends connected to respective said left and right frame members, and respective lower ends configured to bear against an underlying floor surface; and a foot platform mounted on the lower ends of the front legs, wherein the foot platform is configured and arranged to accommodate the feet of a person standing in a position ready to mount the inversion apparatus, wherein the foot platform defines a downwardly facing angled surface; wherein the inversion apparatus has a compact configuration in which in the foot platform is angled relative to the floor surface such that the downwardly facing angled surface engages the floor surface;

wherein a bar is rigidly interconnected between the front legs proximate the lower ends thereof, and the bar and the front legs cooperate to define a U-shaped segment that extends parallel to the floor surface when the inversion apparatus is in an operative configuration on the floor surface, and the foot platform covers the U-shaped segment from above.

2. The inversion apparatus of claim 1, wherein the foot platform spans a gap defined between the left and right front legs.

3. The inversion apparatus of claim 1, wherein the foot platform defines a foot supporting surface that extends parallel to the floor surface.

4. The inversion apparatus of claim 1, wherein each of the front legs is generally L-shaped when viewed from a left side of the inversion apparatus, with a primarily horizontal portion extending parallel to the floor surface, and a primarily vertical portion extending between a respective said horizontal portion and a respective one of the frame members.

5. The inversion apparatus of claim 1, wherein the foot platform has a lower forward corner that is chamfered to define a surface that extends parallel to the floor surface when the front legs are pivoted into the compact configuration.

6. The inversion apparatus of claim 1, wherein the left and right rear legs each include a foot.

7. An inversion apparatus that supports a user in an inverted position relative to an underlying floor surface, comprising:

an inversion table having opposite left and right sides and defining a back supporting surface sized and configured to support a user's back;

left and right frame members configured to movably support respective said sides of the inversion table;

left and right front legs having respective upper ends connected to respective said left and right frame members, and respective lower ends configured to bear against an underlying floor surface, wherein the front legs are pivotally connected to respective said frame members for pivoting about a common axis;

left and right rear legs having respective upper ends connected to respective said left and right frame members, and respective lower ends configured to bear against an underlying floor surface; and a foot platform mounted on the lower ends of the front legs, wherein the foot platform is configured and arranged to accommodate the feet of a person standing in a position ready to mount the inversion apparatus, wherein the foot platform cooperates with the rear legs to support the inversion apparatus in a stable upright position on the floor surface when the front legs are pivoted into a compact configuration relative to the rear legs, wherein the foot platform has a lower forward corner that is chamfered to define a surface that extends parallel to the floor surface when the front legs are pivoted into the compact configuration.

8. The inversion apparatus of claim 7, wherein the right frame member defines a U-shaped flange having a closed end and an open end, and the open end opens toward the right front leg, and the right front leg is pivotal away from the right rear leg until the right front leg reaches the closed end of the flange.

9. The inversion apparatus of claim 7, wherein the rear legs are rigidly connected to the left and right frame members.

10. An inversion apparatus that supports a user in an inverted position relative to an underlying floor surface, comprising:

an inversion table having opposite left and right sides and defining a back supporting surface sized and configured to support a user's back;

left and right frame members configured to movably support the inversion table therebetween;

generally L-shaped left and right front legs having respective upper segments connected to respective left and right frame members, and respective lower segments configured to bear against an underlying floor surface; and left and right rear legs having respective upper ends connected to respective left and right frame members, and respective lower ends configured to bear against an underlying floor surface;

wherein the lower segments of the front legs have forwardmost portions that cooperate with the rear legs to support the inversion apparatus in a stable upright position on the floor surface when the front legs are pivoted into a compact configuration relative to the rear legs, wherein a bar is rigidly interconnected between the forwardmost portions of the front legs, and wherein a foot platform is rigidly mounted on top of the bar, wherein the foot platform defines a downwardly facing angled surface; wherein the foot platform is angled relative to the floor surface such that the downwardly facing angled surface engages the floor surface when the inversion apparatus is in the compact configuration.

11. The inversion apparatus of 10, wherein the foot platform is fastened to the lower ends of the front legs, wherein the foot platform is configured and arranged to accommodate the feet of a person mounting the inversion apparatus.

12. The inversion apparatus of 11, wherein the foot platform spans a gap defined between the lower ends of the left and right front legs.

13. The inversion apparatus of 10, wherein the lower segments of the front legs and the bar cooperate to define a U-shaped member that occupies a parallel orientation relative to the floor surface when the inversion apparatus is in an operative configuration on the floor surface, and a skewed orientation relative to the floor surface when the inversion apparatus is in the compact configuration.

14. The inversion apparatus of claim 10, wherein the foot platform has a lower forward corner that is chamfered to define a surface that extends parallel to the floor surface when the front legs are pivoted into the compact configuration.

15. An inversion apparatus that supports a user in an inverted position relative to an underlying floor surface, comprising:

an inversion table having a left side and a right side;

a left frame member and a right frame member, wherein each said frame member is configured and arranged to movably support a respective said side of the inversion table;

a left first leg and a right first leg, wherein each said first leg has a respective upper end connected to respective said frame member, and a respective lower end configured to bear against an underlying floor surface;

a left second leg and a right second leg, wherein each said second leg has a respective upper end pivotally connected to respective said frame member for pivoting about a common pivot axis, and a respective lower end configured to bear against an underlying floor surface, wherein the left frame member defines a stop configured and arranged to limit pivoting of the left second leg away from the left first leg; and a foot platform fastened to the lower ends of the first legs, wherein the foot platform is configured and arranged to accommodate the feet of a person mounting the inversion apparatus, wherein a bar is rigidly interconnected between forwardmost portions of the lower segments of the first legs, and wherein the foot platform is rigidly mounted on top of the bar, wherein the foot platform has a lower forward corner that is chamfered to define a surface that extends parallel to the floor surface when the front legs are pivoted into a compact configuration.

16. The support frame of 15, wherein the stop is a U-shaped member configured and arranged to receive the left second leg.

17. The support frame of 15, wherein the forwardmost portions cooperate with the second legs to support the inversion apparatus in a stable upright position on the floor surface when the first legs are pivoted into a compact configuration relative to the second legs.

* * * * *